US005581344A

United States Patent [19]

Makita

[11] Patent Number: 5,581,344

[45] Date of Patent: Dec. 3, 1996

[54] IMAGE FORMING APPARATUS WITH COPY SHEET SIZE INPUTTING AND DETECTION AND CORRESPONDING SELECTION OF A COPY SHEET CASSETTE

[75] Inventor: Katsuhiko Makita, Tokyo, Japan

[73] Assignee: Ricoh Company, Ltd., Tokyo, Japan

[21] Appl. No.: 405,206

[22] Filed: Mar. 16, 1995

[30] Foreign Application Priority Data

Mar. 16, 1994 [JP] Japan ..... 6-045652

[51] Int. Cl.[6] ..... G03G 15/00

[52] U.S. Cl. ..... 355/311; 355/313

[58] Field of Search ..... 355/308, 309, 355/311, 313; 271/9.01, 9.06, 9.09

[56] References Cited

U.S. PATENT DOCUMENTS 4,758,865 7/1988 Makita ..... 355/55

4,764,789 8/1988 Iwaki et al. ..... 355/311 X 5,321,486 6/1994 Nanbu et al. ..... 355/311

5,349,422 9/1994 Ohashi ..... 355/311 X

*Primary Examiner*—Joan H. Pendegrass

*Assistant Examiner*—Quana Grainger

*Attorney, Agent, or Firm*—Oblon, Spivak, McClelland, Maier, & Neustadt, P.C.

[57] ABSTRACT

An image forming apparatus in which a copy sheet size input mode is provided whereby an operator inputs copy sheet size data corresponding to copy sheets accommodated in a plurality of copy sheet cassettes. The size data is memorized in the RAM as a data of corresponding copy sheet cassette. Thereby, sensors adjacent to the copy sheet cassettes for sensing the size of the copy sheet accommodated in the cassettes can be omitted.

5 Claims, 5 Drawing Sheets

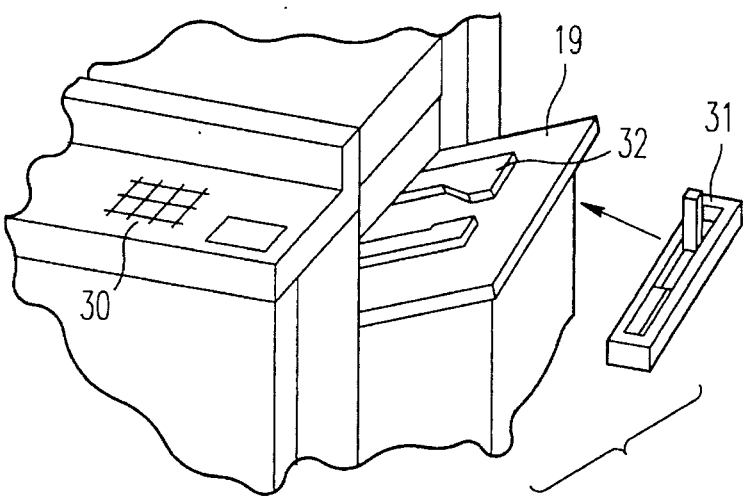
FIG. 2
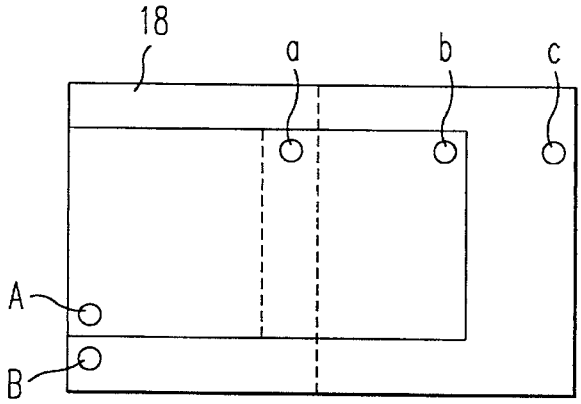
FIG. 3a
| A | B | a | b | c | SENSED SIZE |
|---|---|---|---|---|---|
| ON | ON | ON | ON | ON | A-3 |
| ON | OFF | ON | ON | OFF | B-4 |
| ON | ON | ON | OFF | OFF | A-4 |
| ON | OFF | OFF | OFF | OFF | B-5 |
FIG. 3b

IMAGE FORMING APPARATUS WITH COPY SHEET SIZE INPUTTING AND DETECTION AND CORRESPONDING SELECTION OF A COPY SHEET CASSETTE

BACKGROUND OF THE INVENTION

1. Field of the Invention

The present invention relates to an improvement of a copy sheet size inputting and detecting device for an image forming apparatus, such as, for example, a copier, a facsimile machine, a printer, and so on.

2. Discussion of the Background

In the conventional copying apparatus, a copy sheet size is sensed automatically, in a number of ways mentioned below. First, a code indicative of the copy sheet size is labeled to the copy sheet cassette, and the code is read by a sensing device when the cassette is set into the copy machine. Second, a size sensing device is interconnected to a side plate slidably mounted on the copy sheet cassette, and thereby the size is sensed when the side plate is adjusted to the side edge of the copy sheet. Third, a size setting device manually settable by the operator is disposed on the copy sheet cassette, and thereby, the size is recognized by a sensing device disposed in the copy machine when the cassette is set therein.

However, the above mentioned devices each employ an extra sensing means at the copy sheet cassette for sensing the size of the copy sheet accommodated in the copy paper cassette, and thereby the cost is raised.

SUMMARY OF THE INVENTION

Accordingly, one object of the present invention is to provide a novel image forming apparatus in which a copy size sensing device for sensing the size of a copy sheet accommodated in a copy paper cassette is omitted.

The above object and other objects are achieved by providing a novel image forming apparatus in which copy sheet size data are input manually by the operator or automatically, and stored in a memory (RAM) before the copy operation is commenced.

The present invention has been developed in recognition of the fact that almost all users of the copy machines customarily set copy sheets having predetermined size to a predetermined copy sheet cassette even if the copy sheets are settable to every one of the cassettes of the copy machine.

According to the present invention, the sensor adjacent to the copy sheet cassette for sensing the size of the copy sheet can be omitted since the copy sheet size is input manually or automatically. On the other hand, the sensor for sensing the original document disposed below the contact glass is not omitted and in one embodiment is also utilized for sensing the copy sheet size when the copy sheet is set on the contact glass. In this way, the size sensor disposed adjacent the copy sheet cassette is omitted.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 2 is a perspective view of a part around the manual copy sheet tray of the copy machine employing the present invention;

FIG. 3*a* is a plan view of the original document size sensor showing the positioning both of the sensors and the documents of the present invention;

FIG. 3*b* is a table showing the condition for judging the presence or absence of an original document and the size of the document set on a contact glass plate of a copy machine;

DETAILED DESCRIPTION OF THE PREFERRED EMBODIMENTS

Figure 1:
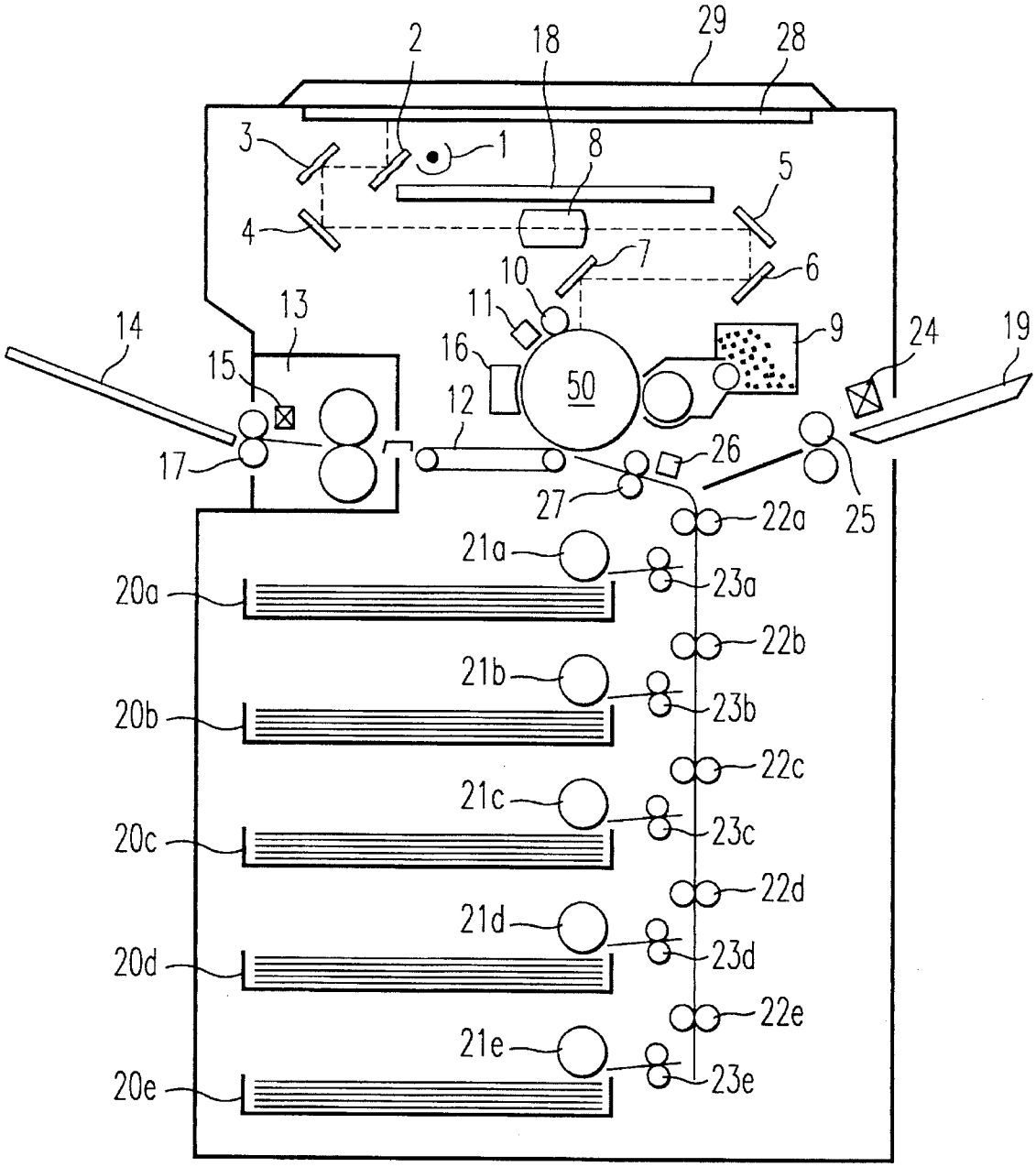
FIG. 1 is a sectional view of the copy machine embodiment employing the present invention.

Referring now to the drawings, wherein like reference numerals designate identical or corresponding parts throughout the several views, and more particularly to FIG. 1 thereof, as shown in FIG. 1, an exposure lamp 1, a reflecting mirrors 2~7, lens 8, a photo-conductive drum 50, a developing unit 9, a discharging roller 10, a charge eliminating lamp 11, a cleaning unit 16, a transferring belt 12, a fixing unit 13, an ejecting tray 14, an ejection sensor 15, an ejecting roller 17, a manual document setting tray 19, a manual document setting sensor 24, a feeding roller 25 for a manually set document, feeding trays 20*a*~*e*, feeding rollers 21*a*~*e*, transferring rollers 22*a*~*e*, separating rollers 23*a*~*e*, a resisting sensor 26, a resist roller 27, etc, are provided in the copy machine. A contact glass 28 and document cover 29 are provided on the top of the copy machine. Further, document size sensors 18 for sensing the size of the original document set on the contact glass 28 are provided under the contact glass 28. In the embodiment of the present invention, each size copy sheet is changeably set into any one of the copy sheet cassettes (20*a*~*e*).

As shown in FIG. 2, the manual document setting tray 19 is provided and a side fence 32, which is slidable in a direction parallel to the width of the copy sheet, is disposed in the tray 19. A slide resistance 31 is provided in the tray 19, and cooperates with the slide action of the side fence 32. Thereby, the size of the copy sheet set on the tray is sensed by the slide resistance 31. Further, an operation panel 30 is provided on the top of the copy machine.

As shown in FIG. 3*a*, the document size sensor 18 consist of sensors A, B, a, b and c. The sensors A, B are disposed at the left and front side of the copy machine. The sensors a, b, and c are disposed at places far from the front side of the copy machine.

Here, the lower side of the FIG. 3*a* corresponds to the front side of the copy machine.

These sensors are light reflecting photo-sensors which detect the presence or absence of the document, and the size of the original document set on the contact glass 28 is judged referring to a table as shown in FIG. 3*b*.

For example, if all of the sensors detect the presence of the original document set on the contact glass 18, it is judged to be size A-3, whereas if only the sensor A detects the presence of the original document, it is judged to be size B-5.

Figure 4:
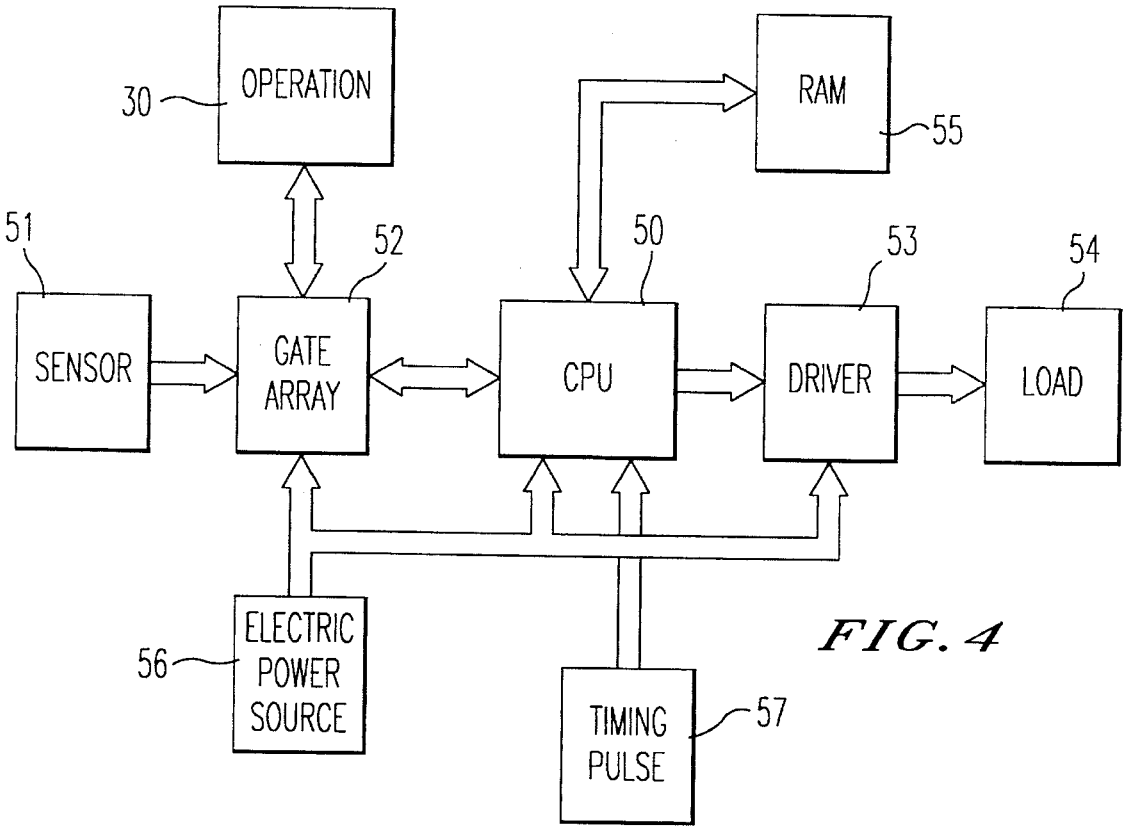
FIG. 4 is a block diagram illustrating functional control performed according to the present invention.

As shown in FIG. 4, each of the elements coupled to the CPU 50 is controlled by the CPU 50 as described below. A signal generated by a sensing element 51, (for example, ejection sensor 15 or the original document sensor 18, etc.) is input to a CPU 50 through a gate array 52. Also, a signal generated by an operating panel 30 is input to the CPU 50 through the gate array 52.

On the other hand, a display signal generated by the CPU 50 is sent to the operating panel 30 through the gate array 52.

A RAM 55 is connected to the CPU 50 so that data are communicated between the RAM 55 and the CPU 50.

Also, a driving signal generated by the CPU 50 is output to a driver 53, and a load 54 (for example, an exposure lamp 1, a charge removing lamp 11, a transferring roller 21, etc.) is energized.

Electric power is supplied to the CPU 50, a gate array 52 and the driver 53 from an electric power source 56. Further, a timing pulse 57 generated by a pulse generator, not shown in the figures, is supplied to the CPU 50, and the CPU operates in synchronism with the pulse.

Hereinafter, the operation panel 30 is explained in detail referring to FIG. 5.

Figure 5:
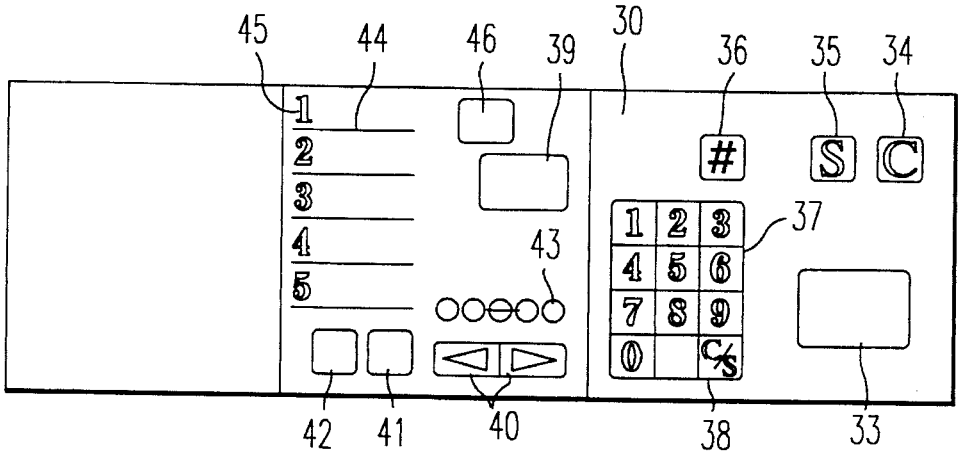
FIG. 5 is a plan view of a control panel of an apparatus according to the present invention.

As shown in FIG. 5, a copy start key 33, a copy mode clear key 34, a sheet size input mode key 35, a data enter key 36, a ten-key 37, a copy clear/stop key 38, a copied number display 39 displaying the number of copied sheets, a copy density set key 40, an auto sheet select key 41, a manual sheet select key 42, a density display 42, a sheet size display 44 for each of the copy sheet cassettes, a selected copy sheet cassette display 45, a size input error display 46, etc., are provided on the operation panel 30.

Next, a first embodiment of the present invention, namely, a way to input the copy sheet size, is explained in detail.

As shown in FIG. 1, the copy machine has five trays (20*a~e*). In the case a size of each of the copy sheets accommodated in the trays should be input to the memory, the sheet size input mode key 35 on the operation panel 30 is depressed.

Then, a first part of the display 44 goes on and off to indicate the machine is ready to accept an input of copy sheet size data for the first copy sheet cassette 20*a*.

Namely, if a copy sheet of A-3 size is already accommodated in the first copy sheet cassette 20*a*, size data indicative of A-3 copy sheet size should be input to a memory (RAM 50). Therefore, a code corresponding to the size of A-3 is input manually from the turn key 37.

After that the data entering key 36 is depressed by the operator, so that the size data of A-3 for the first cassette 20*a* is stored in the RAM 55.

Then, a second part of the display 44 goes on and off to indicate the machine is ready to accept input of the next copy sheet size for the next copy sheet cassette 20*b*. The next input is executed in the same manner as mentioned above, and further inputs for the other cassettes are continued until the size data for last sheet cassette is input. Thereafter, the copy sheet size input mode is cleared by depressing the copy mode clear key 34.

Next, a second embodiment of the present invention, utilizing a different way to input the copy sheet size is explained.

In the case that the size of each of the copy sheet accommodated in the cassettes 20*a~e* are to be input to the memory, the sheet size input mode key 35 on the operation panel 30 is depressed. Then, the first part of the display 44 goes on and off to indicate the machine is ready to accept an input of the copy sheet size data for the first copy sheet cassette 20*a*.

If the size of copy sheet accommodated in the first tray is A-3, a copy sheet is extracted from the copy sheet cassette and laid on the contact glass 28 by the operator. Then the sheet is ready by the five sensors (A, B, a, b and c) and the size thereof is judged referring to the table as shown in FIG. 3*b*. Thereafter, the result of the judgement is sent to the CPU 50 as a size data for the first sheet cassette, when the data enter key 36 on the panel 30 is depressed.

After the CPU 50 judges whether or not the size sensed by the five sensors is available (i.e., the copy sheet does not have an informal size nor is the sheet transparent) for the copy machine.

If the size is available, the same is memorized into the RAM 55 and, on the other hand, displayed on the sheet size display 44 under the control of the CPU 50.

In this case, the size of A-3 is displayed thereon. After that, the first column of the display 44 stops going on and off and indicates the completion of the input of the size data for the first copy sheet cassette 20*a*.

Next, the second display starts going on and off to inform the operator to be ready to accept a size data input for the second copy sheet cassette 20*b*. Then, the size input is executed in the same manner as mentioned above. Thereafter, such input of the copy sheet size data is consecutively executed until the size for the last copy sheet cassette 20*e* is input, whereupon the copy sheet size input mode is cleared by the operator depressing the key 35.

Thus, the copy sheet size need not be sensed by a sensor disposed in or adjacent to the copy paper cassette. Instead, the size data is input manually by the operator, or automatically by using the original document size sensor, which normally senses the original document size for certain purposes.

Figure 6:
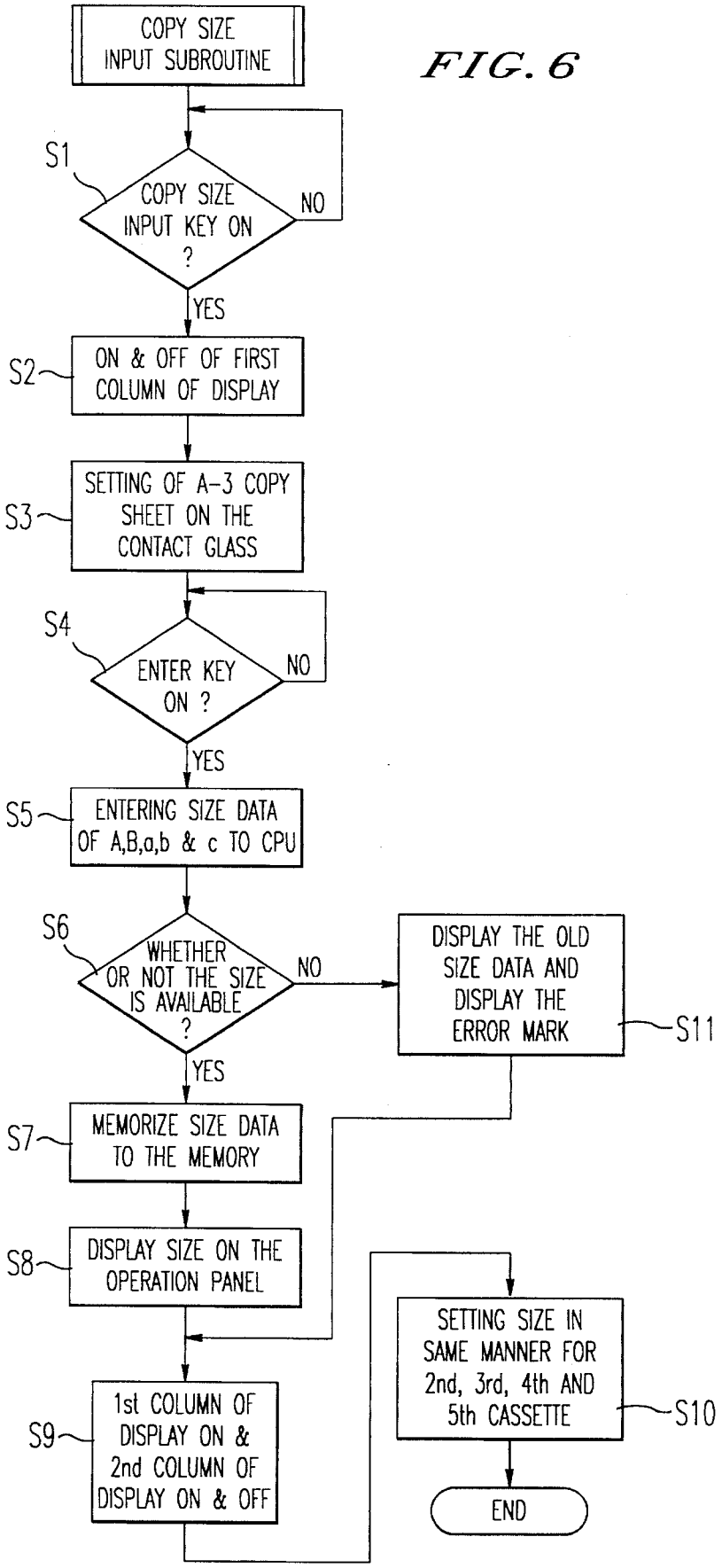
FIG. 6 is a flow chart illustrating the operation of a copy size input routine according to one embodiment of the present invention.

Hereinafter, each of the steps of the copy sheet size input mode of the second embodiment is explained, referring to the flow chart as shown in FIG. 6.

In step S1, whether or not the sheet size input mode key 35 is depressed is judged.

If the result is "Yes", the first column of the display 44 starts going on and off in step S2. If "No", the routine loops back to repeat step S1.

In step S3, the operator sets the copy sheet, which is one of the copy sheets newly accommodated in the first cassette 20*a*.

In step S4, whether or not the data enter key 36 is depressed is judged.

If the result is "Yes", the size data sensed by the document size sensor 18 is input into the CPU 50 in step S5.

In step S6, whether or not the sensed copy sheet size is available for the copy machine is judged.

If the result is "No", the size data, memorized in the RAM 55 before-hand at the factory where the copy machine is produced, is displayed. In addition, a mark indicative of wrong input is displayed on the display 44.

If the result is "Yes" in the step S6, the size data, newly sensed, is memorized in the RAM 55 instead of the pre-memorized size data in the step S7, and, in addition, the size is displayed on the display 44 in step S8.

In step S9, a mark indicative of completion of the input of the copy sheet size for the first sheet cassette 20*a* is displayed, and a mark indicative of being ready to accept a next copy sheet size input for next copy sheet cassette is displayed by indicating going on and off, correspondingly.

In step S10, the copy size input is executed continuously in the same manner as mentioned above in each of the steps until the fifth input of the copy sheet size for the fifth copy sheet cassette 20*e* is completed.

Next, the third embodiment of the present invention is explained in detail.

In the third embodiment, an input of the copy sheet size is executed by using a sensor for sensing the width of the copy sheet set on a manual setting tray 19 and another sensor for sensing a longitudinal length of the copy sheet disposed in a sheet transferring path.

However, the other mechanical structure aspects of the third embodiment are almost same as that of the first and second embodiment as mentioned above. Therefore, only the way the copy sheet size is inputted is explained.

As shown in the previous embodiment, five copy sheet trays are provided in the copy machine.

In the case the copy sheet size accommodated in each of the trays (20*a~e*) is to be input, the copy sheet size input mode key 35 on the operation panel 30 is depressed.

Then, the first column of the display 44 starts going on and off to indicate the machine is ready to accept an input of the copy sheet size data for the first copy sheet cassette 20*a*.

Then the copy sheet is manually set on the manual setting tray 19 so that a copy sheet is fed into the copy machine.

During setting of the copy sheet thereon, the operator adjusts a side fence 32 to the copy sheet side edge, thereby, the width is sensed by a slidable resistance 31 interconnected to the side fence 32, and the data thereof is input to the CPU 50 (See FIG. 2).

After that, the copy start key 33 is depressed to energize a driving motor, not shown in the figures. Then, a feeding roller 25 rotates and feed the copy sheet forward.

After that a counter, not shown in the figures, disposed in the CPU starts counting the time, during which the copy sheet passes through a resist sensor 26 disposed on the path, so that the length of the copy sheet is checked. The CPU 50 then judges copy sheet size based on the data of the width of the copy sheet obtained by the slidable resister 31 and the data of the length thereof obtained by the resist sensor 26.

After that the CPU 50 judges whether or not the size is available (i.e., whether the copy sheet is not an informal size or a transparent sheet) for copy machine.

If the size is available, the size data is memorized into the RAM 55 and, on the other hand, displayed in the sheet size display 44 under the control of the CPU 50. Then, the first column of the display 44 stops going on and off and stays on to indicate the completion of inputting of the copy sheet size for the first tray 20*a*.

When ejection of the copy sheet, the size of which is sensed, is detected by an eject sensor 15, the driving motor is stopped.

In this mode, it is unnecessary to form an image of the copy sheet and therefore, an image forming device, for example, a scanner 1, is not employed.

Then, the second column of the display 44 starts going on and off to inform the operator the machine is ready to accept a next size input for the second sheet cassette 20*b*, which is executed in the same manner as mentioned above.

In this way, the input of the copy sheet size is consecutively executed until the size for the last (fifth) copy sheet cassette is input to the RAM 55.

After that, the sheet size input mode is finished.

Figure 7:
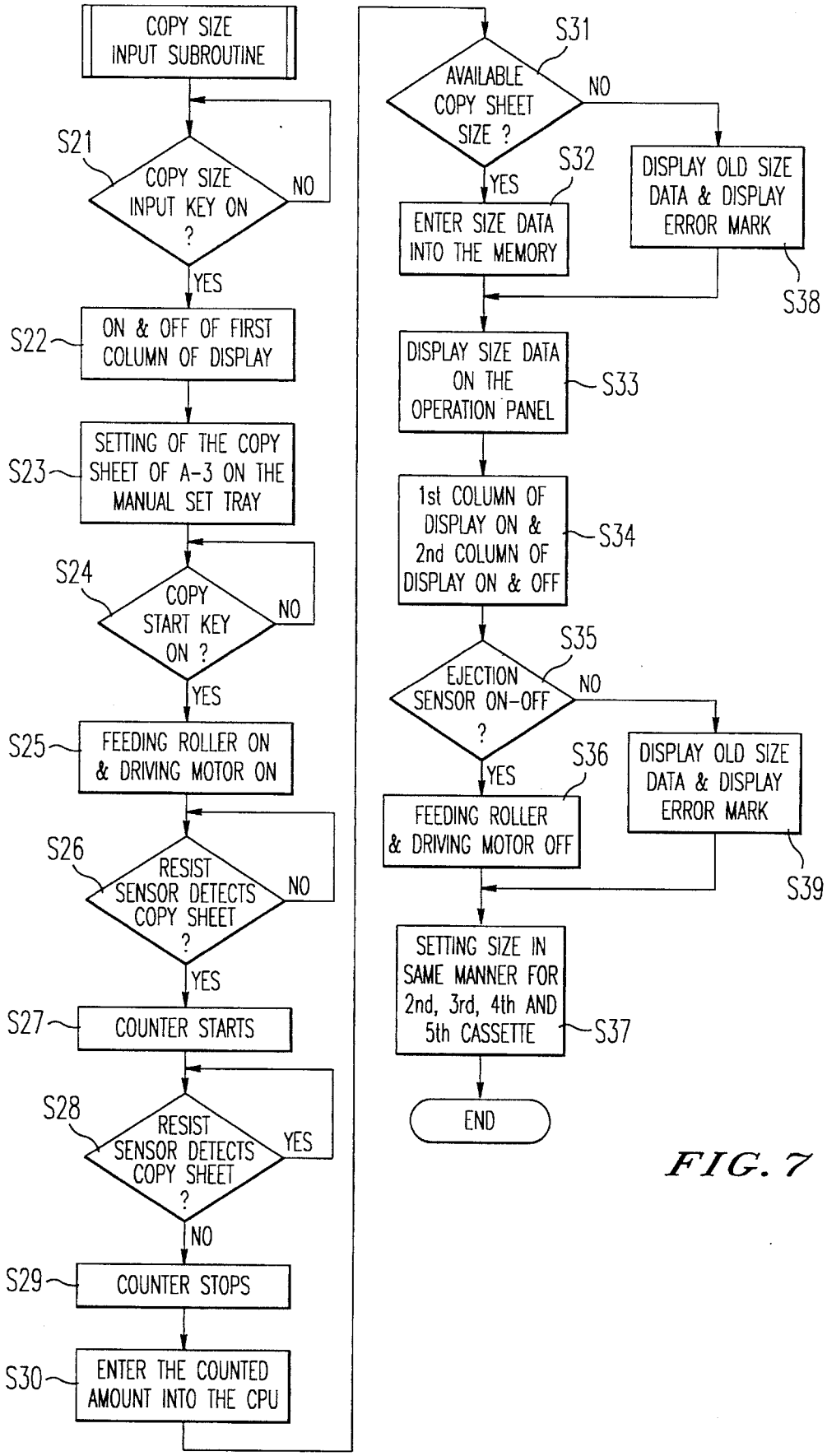
FIG. 7 is a flow chart and a label chart, respectively, of a copy size input routine according to another embodiment of the present invention.

Next, another way to input the copy sheet size is explained referring to the flow chart shown in FIG. 7.

In step S21, whether or not the sheet size input mode key 35 is depressed is judged. If, the result of the judgement is "Yes", the first column of the display 44 goes on and off, in step S22. If "No", the routine loops back to repeat step S21.

In step S23, the copy sheet is set on the manual copy sheet tray 19 by the operator.

In step S24, whether or not the copy start key 33 is depressed is judged.

In step S25, the driving motor and the feeding roller is activated.

In step S26, whether or not the resist sensor 26 detects a copy sheet is judged.

In step S27, counting the time corresponding to the length of the copy sheet is started.

In step S28, whether or not the resist sensor 26 is still detecting the copy sheet is judged.

In step S29, counting is stopped when the predetermined amount is count up.

After that, the counted amount is input to the CPU 50 in step S30.

In step S31, whether or not the detected length and width of the copy sheet is suitable for the copy machine is judged.

If the result of the judgement is "No", the information memorized beforehand in the RAM is displayed and an error mark is displayed in step S34, and the process is forwarded to step S34.

If the result of the judgement is "Yes" in the step S31, the information of the copy sheet size sensed is stored in the RAM 55 and displayed in step S32.

Then, a mark indicative of completion of the detection of the size for the first copy sheet cassette 20*a* is displayed, and the second column of the display 44 for displaying the size accommodated in the second copy sheet cassette 20*b* goes on and off in step S34.

In step S35, whether or not the copy sheet is ejected is judged If the result of the judgement is "Yes", the driving motor and the feeding rollers 25, 27, and 17 are stopped in step S36. If the result of step S35 is "No", in step S39 the size data and an error mark are displayed.

After that, in the step S37 next input for next copy sheet cassette 20*b* is executed by the operator in the same manner as mentioned above.

Thus, the first and third embodiments of the present invention are applicable to a printer, which does not have a scanner and a document sensor for sensing the original document.

Next explained is an embodiment in which the size data are not memorized beforehand in the RAM 55.

In that case, the pre-input copy sheet size information is not suitable, for example, because a different sized copy sheet is newly accommodated into one of the copy sheet cassette, or the operator mistakenly input a wrong size of the copy sheet in an above mentioned mode. Then the operator sets the copy size input mode again by depressing the size input mode key 35, and inputs new correct size data of the copy sheet for the corresponding cassette in the same manner as mentioned above.

Thereby, the old size data in the RAM 55 are replaced with correct size data.

According to the present invention, a sensor adjacent to the copy sheet cassette for sensing the size of the copy sheet accommodated in the copy sheet cassette can be omitted.

Therefore, the cost is minimized.

Further, the copy sheet size input is executed easily and the input is accurately performed.

Obviously, numerous modifications and variations of the present invention are possible in light of the above teachings. It is therefore to be understood that within the scope of the appended claims, the invention may be practiced otherwise than as specifically described herein.

What is claimed as new and is desired to be secured by letters patent of the United States is:

1. An image forming apparatus having plurality of copy sheet cassettes, in which different sizes of copy sheet can be accommodated, comprising:

a manual inputting means for manually inputting a size data of said copy sheet accommodated in each of said copy sheet cassette;

a memory for memorizing each of said size data; and a controller for controlling said image forming apparatus according to said size data.

2. An image forming apparatus having plurality of copy sheet cassettes, in which different sizes of copy sheet can be accommodated, comprising:

a contact glass on which a document to be copied is set;

a document size sensor means for sensing a size of said document, disposed beside said contact glass;

a memory for memorizing a copy sheet size data;

means for initiating a copy sheet size input mode, wherein a size of said copy sheet is sensed when said copy sheet is set on said contact glass and input to said memory means; and a controller for associating at least one of said copy sheet cassettes with copy sheet size data memorized in said memory and controlling said image forming apparatus according to said copy sheet size data so associated.

3. An image forming apparatus having plurality of copy sheet cassettes, in which different sizes of copy sheet can be accommodated, comprising:

a manual copy sheet tray on which a copy sheet is set manually, said manual copy sheet tray including a first size sensor means for sensing a width of the copy sheet set in said tray;

a second size sensor means disposed in a sheet transferring path for sensing a longitudinal length of said copy sheet;

means for initiating a copy sheet size input mode, wherein a width of said copy sheet is sensed by said first size sensor means when one of predetermined sizes of said copy sheet is set on said manual copy sheet tray, said copy sheet is fed from said tray into the sheet transferring path in the image forming apparatus and the longitudinal length of the copy sheet is sensed by said second size sensor means; and a controller for associating at least one of said copy sheet cassettes with copy sheet size data memorized in said memory and controlling said image forming apparatus according to said copy sheet size data so associated.

4. An image forming apparatus as claimed in claims 1, 2 or 3, wherein said memory means comprises a random access memory.

5. Image forming apparatus as claimed in claims 1, 2 or 3, further comprising;

a display means for displaying a mark indicative of being ready to input size data into said memory means when a copy size input mode is set, said mark also indicative of completion of said inputting of said copy sheet size data when said inputting of said copy sheet size data is executed.

* * * * *